US008935866B2

(12) United States Patent
Bienfang

(10) Patent No.: US 8,935,866 B2
(45) **Date of Patent: *Jan. 20, 2015**

(54) POWER SHOVEL HAVING HYDRAULICALLY DRIVEN DIPPER ACTUATOR

(71) Applicant: Caterpillar Inc., Peoria, IL (US)

(72) Inventor: David Thomas Bienfang, Racine, WI (US)

(73) Assignee: Caterpillar Inc., Peoria, IL (US)

( * ) Notice: Subject to any disclaimer, the term of this patent is extended or adjusted under 35 U.S.C. 154(b) by 109 days.

This patent is subject to a terminal disclaimer.

(21) Appl. No.: 13/748,125

(22) Filed: Jan. 23, 2013

(65) Prior Publication Data

US 2014/0205412 A1 Jul. 24, 2014

(51) Int. Cl.
*E02F 3/30* (2006.01)
*E02F 3/42* (2006.01)

(52) U.S. Cl.
CPC ..... *E02F 3/425* (2013.01); *E02F 3/306* (2013.01)
USPC ..... 37/445

(58) Field of Classification Search
CPC ..... E02F 3/304; E02F 3/4075; E02F 3/425; E02F 3/308; E02F 3/40; F16D 55/00; F16D 2121/02
USPC ..... 37/195, 398, 442–445, 196; 414/565, 414/699, 706, 715, 726; 60/469; 188/217, 188/312, 317; 294/119.4, 192
See application file for complete search history.

(56) References Cited

U.S. PATENT DOCUMENTS

| | | | | |
|---|---|---|---|---|
| 2,164,126 | A | 6/1939 | Stevens | |
| 4,046,270 | A | 9/1977 | Baron et al. | |
| 4,063,373 | A * | 12/1977 | Greer et al. | 37/444 |
| 4,074,770 | A | 2/1978 | Frisbee | |
| 4,517,756 | A | 5/1985 | Olds et al. | |
| 5,829,949 | A | 11/1998 | Brown | |
| 5,839,213 | A | 11/1998 | Abbott et al. | |
| 6,219,946 | B1 | 4/2001 | Soczka | |
| 6,467,202 | B1 | 10/2002 | Brown, Jr. | |
| 7,096,610 | B1 | 8/2006 | Gilmore | |
| 8,136,272 | B2 | 3/2012 | Hren et al. | |
| 8,732,994 | B2 * | 5/2014 | Dube et al. | 37/445 |

(Continued)

OTHER PUBLICATIONS

"Electric Mining Shovel Productivity Enhancements: Using Innovation to Increase Machine Availability" by Doll, Robert J., pp. 1-7., Bucyrus International, 1100 Milwaukee Avenue, South Milwaukee, WI, USA.

U.S. Patent Application of David Thomas Bienfang et al., entitled "Maching Having Dipper Actuator System" filed on Jan. 23, 2013.

(Continued)

*Primary Examiner* — Robert Pezzuto
(74) *Attorney, Agent, or Firm* — Finnegan, Henderson, Farabow, Garrett & Dunner LLP

(57) ABSTRACT

A hydraulic system for a power shovel may have a tank, a pump configured to draw fluid from the tank and pressurize the fluid, a crowd cylinder extendable and retractable to adjust a length of a dipper handle, and a valve in fluid communication with the tank, the pump, and the crowd cylinder. The valve may be movable to fill chambers of the crowd cylinder with fluid pressurized by the pump and to drain the chambers of the crowd cylinder to cause extension and retraction of the crowd cylinder. The hydraulic system may also have a dipper actuator located at an end of the crowd cylinder, and a passage extending through the crowd cylinder to communicate with the dipper actuator.

20 Claims, 3 Drawing Sheets

(56) References Cited

U.S. PATENT DOCUMENTS

| | | | |
|---|---|---|---|
| 2011/0146114 | A1 | 6/2011 | Hren et al. |
| 2011/0239494 | A1 | 10/2011 | Dubé et al. |

OTHER PUBLICATIONS

U.S. Patent Application of David Thomas Bienfang, entitled "Power Shovel Having Hydraulically Driven Dipper Actuator" filed on Jan. 23, 2013.

* cited by examiner

POWER SHOVEL HAVING HYDRAULICALLY DRIVEN DIPPER ACTUATOR

TECHNICAL FIELD

The present disclosure is directed to a dipper actuator and, more particularly, to a power shovel having a hydraulically driven dipper actuator.

BACKGROUND

Power shovels are in a category of excavation equipment used to remove large amounts of overburden and ore during a mining operation. One type of power shovel is known as a rope shovel. A rope shovel includes a boom, a dipper handle pivotally connected to a mid-point of the boom, and a shovel (also known as a dipper) pivotally connected at one end of the dipper handle. A cable extends over a pulley at a distal end of the boom and terminates at the end of the dipper handle supporting the shovel. The cable is reeled in or spooled out by electric, hydraulic, and/or mechanical motors to selectively raise and lower the shovel.

In most rope shovels, the shovel includes a door that is selectively swung open to dump material from the shovel into a waiting haul vehicle. The door is pivotally connected at one edge to a shovel body, and mechanically latched at an opposing edge. A cable (historically a rope and, hence, the term "rope shovel") extends from an operator cabin over a boom-mounted pulley to the shovel latch. In this configuration, an operator can actuate the latch from inside a cabin of the shovel by tensioning the cable. When the shovel is held horizontally, tensioning the cable causes the latch to release the door and the door falls open under the force of gravity. When the shovel is held vertically, the door swings shut against the shovel body under the force of gravity, and the latch is biased to re-engage and hold the door in the closed position.

Although adequate for some applications, use of the cable to manually cause actuation of the dipper latch can be problematic in other applications. In particular, typical latches and associated cable linkages are under tremendous strain and cycle continuously. As a result, these components suffer high-cycle fatigue and must be serviced frequently to ensure that the latch operates effectively when manipulated by the operator via the cable. This frequent servicing results in machine downtime and lost productivity. Accordingly, an alternative source of power and control at the dipper latch is desired.

One attempt to improve durability of the dipper is disclosed in a technical article titled "ELECTRIC MINING SHOVEL PRODUCTIVITY ENHANCEMENTS: USING INNOVATION TO INCREASE MACHINE AVAILABILITY" that was written by Ronald J. Doll and published in 2009 ("the Doll paper"). In particular, the Doll paper describes a dipper having a new door that does not require a latch. Instead, the door includes an over-center link attached along a back side of the door, and a cam that selectively moves the link over-center during actuation. The cam is connected to a lever arm, which has a cable attached at one end. The cable is selectively tensioned by the operator to pivot the link, rotate the cam, and open the door when the door is in a position for gravity to pull it away from the dipper.

Although the dipper disclosed in the Doll paper may have improved durability because it no longer includes a latch, it may still be less than optimal. In particular, the door mechanism described in the Doll paper is still powered and/or controlled by the operator via a cable. This method of controlling and powering door actuation may still be prone to malfunctions.

The power shovel and dipper actuator of the present disclosure solve one or more of the problems set forth above.

SUMMARY

In one aspect, the present disclosure is directed to a hydraulic system for a power shovel. The hydraulic system may include a tank, a pump configured to draw fluid from the tank and pressurize the fluid, a crowd cylinder extendable and retractable to adjust a length of a dipper handle, and a valve in fluid communication with the tank, the pump, and the crowd cylinder. The valve may be movable to fill chambers of the crowd cylinder with fluid pressurized by the pump and to drain the chambers of the crowd cylinder to cause extension and retraction of the crowd cylinder. The hydraulic system may also include a dipper actuator located at an end of the crowd cylinder, and a passage extending through the crowd cylinder to communicate with the dipper actuator.

In another aspect, the present disclosure is directed to a method of operating a power shovel. The method may include pressurizing fluid, and directing pressurized fluid to chambers of a crowd cylinder and draining fluid from the chambers of the crowd cylinder to cause the crowd cylinder to adjust a length of a dipper handle. The method may also include directing pressurized fluid through the crowd cylinder to a dipper actuator located at an end of the crowd cylinder.

and

Figure 1:
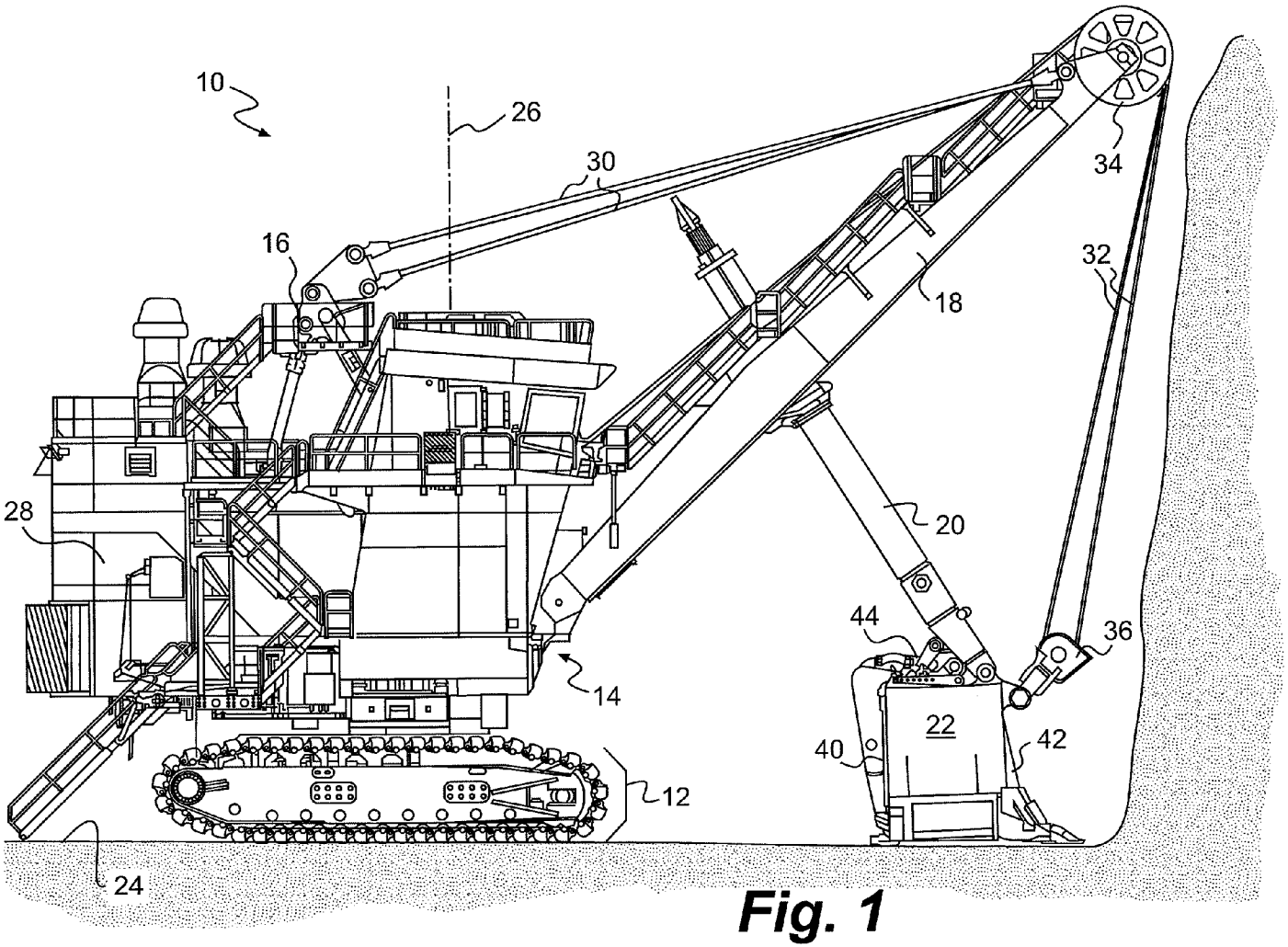
FIG. 1 is a schematic illustration of an exemplary disclosed machine.
Figure 2:
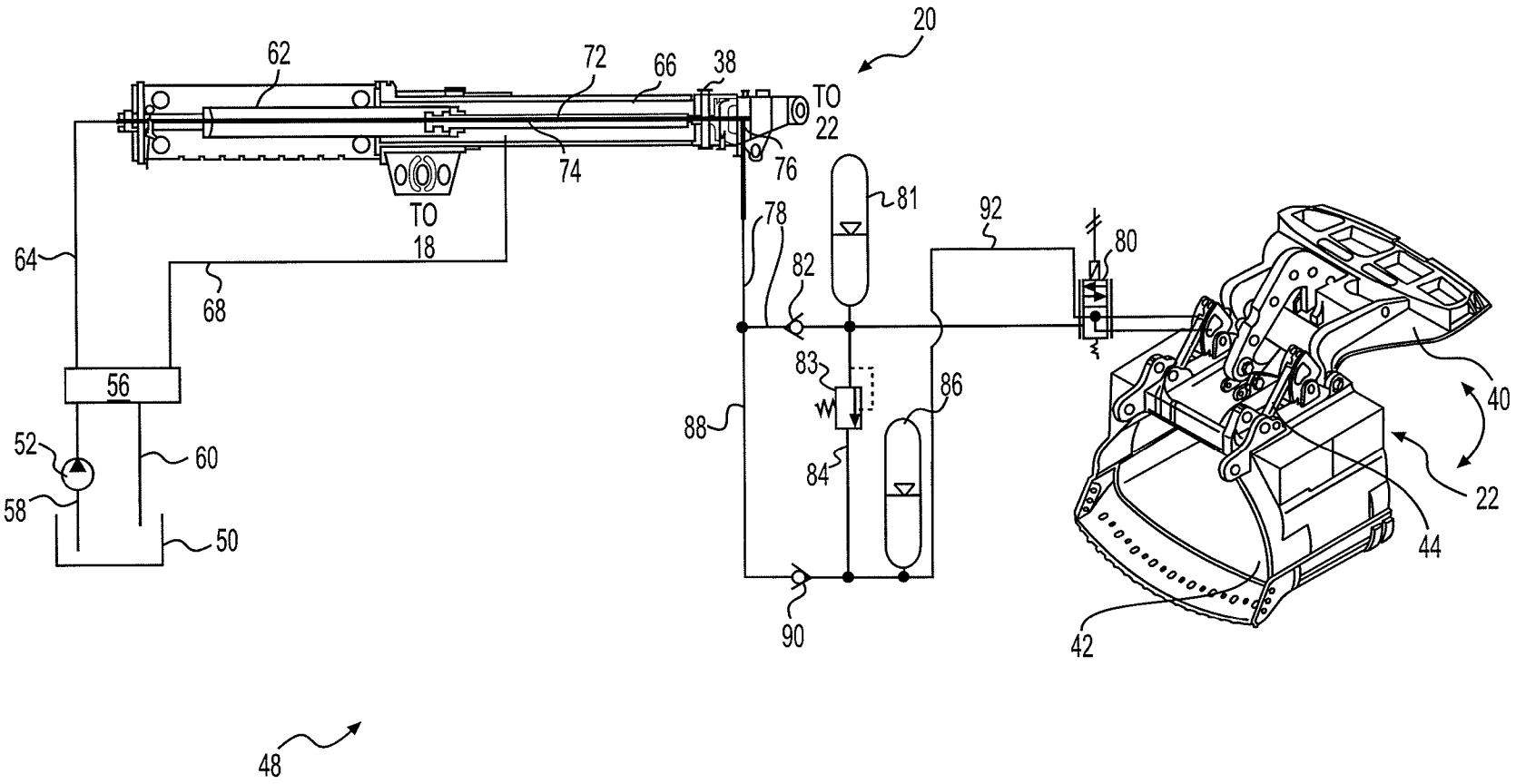

FIG. 2 is schematic illustration of an exemplary disclosed hydraulic system associated with the machines of FIGS. 1 and 2.

DETAILED DESCRIPTION

Figure 1A:
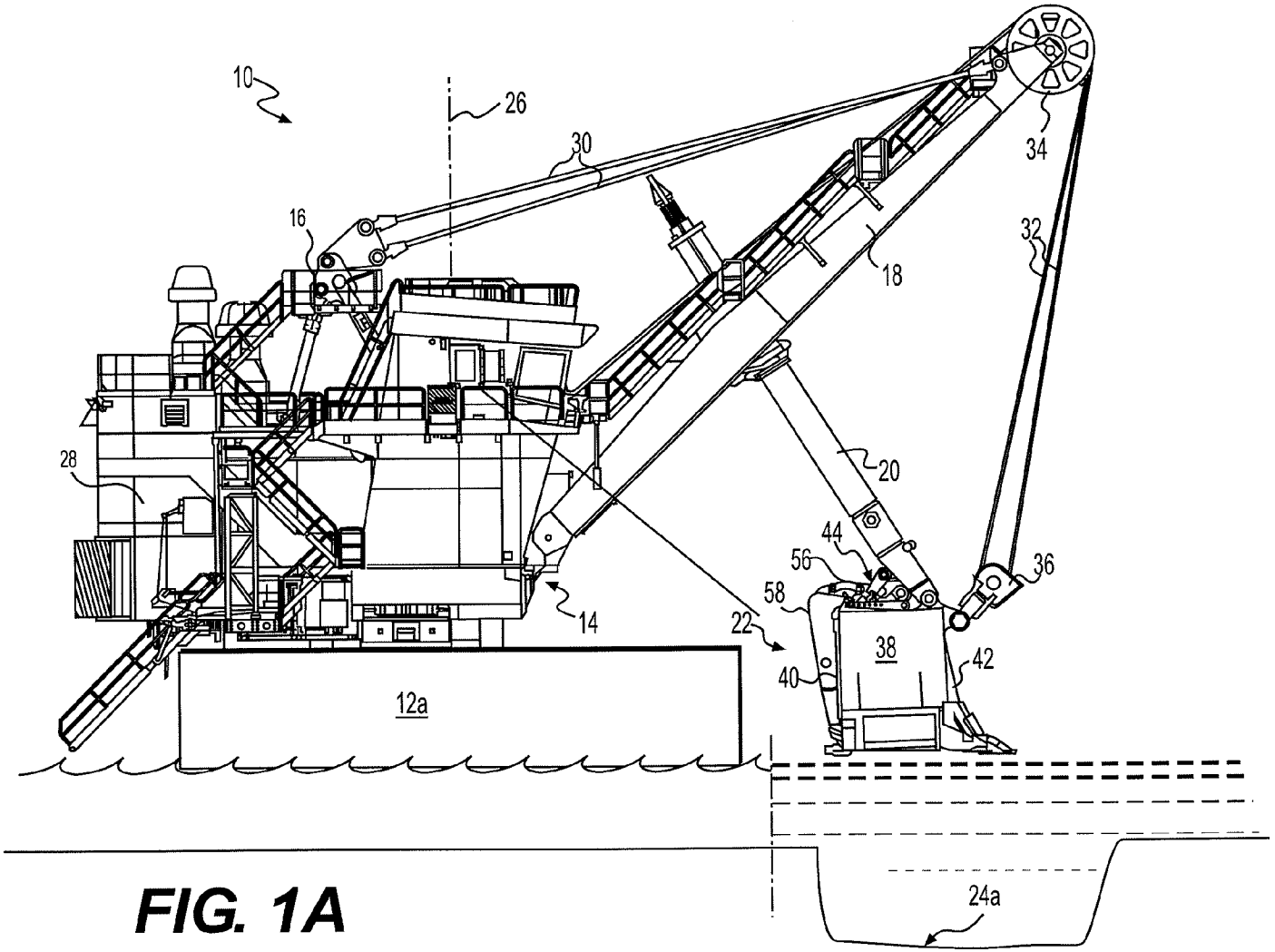
FIG. 1*a* is a diagrammatic illustration of another exemplary disclosed machine.

FIGS. 1 and 1*a* illustrate exemplary embodiments of a machine 10. Machine 10 may perform some type of operation associated with an industry such as mining, construction, or any other industry known in the art. For example, machine 10 may embody an earth moving machine such as the power shovel depicted in FIG. 1 or the dredge depicted in FIG. 1*a*. In the embodiment of FIG. 1, machine 10 may include a base 12, a body 14 operatively connected to base 12, a gantry member 16 rigidly mounted to a top side of body 14 opposite base 12, a boom 18 pivotally connected to a leading end of body 14, a dipper handle 20 pivotally connected to a midpoint of boom 18, a tool 22 pivotally connected to a distal end of dipper handle 20, and cabling connecting gantry member 16, boom 18, dipper handle 20, and tool 22. In the exemplary embodiment of FIG. 1*a*, machine 10 may include each of the components noted above, except that base 12 may be placed within a barge 12*a* configured to support machine 10 in aqueous and/or semi-aqueous environments.

Base 12 (or barge 12*a*) may be a structural unit that supports movements of machine 10. In the disclosed exemplary application, base 12 is itself movable, having one or more traction devices such as feet, tracks (shown in FIG. 1), and/or wheels that are driven to propel machine 10 over a work surface 24. In other applications, however, base 12 may be a stationary platform configured for direct engagement with work surface 24. As shown in FIG. 1*a*, in still further embodiments, barge 12*a* may be stationary and/or moveable over a body of water, and a work surface 24*a* may embody an underwater trench and/or other like underwater surface. In exemplary embodiments, at least a portion of barge 12*a* may be configured for fixed engagement with an underwater surface proximate work surface 24*a*.

Body 14 may pivot relative to base 12 or barge 12*a* (FIG. 1*a*). Specifically, body 14 may pivot relative to base 12 or barge 12*a* about a substantially vertical axis 26. As body 14 is pivoted about axis 26, attached gantry member 16, boom 18, dipper handle 20, and tool 22 may likewise pivot to change a radial engagement angle of tool 22 with work surface 24, 24*a*. In the exemplary embodiment of FIG. 1, tool 22 typically engages with the vertical portion of work surface 24, and the horizontal portion of work surface 24 may be formed as a result of such engagement. The horizontal portion of work surface 24 may be removed by tool 22 in subsequent passes and/or by additional machines located proximate word surface 24. Alternatively, in the exemplary embodiment of FIG. 1*a*, tool 22 may engage a working face and/or other portion of work surface 24*a* disposed below the waterline (i.e., underwater). Body 14 may house, among other things, a power source 28 that powers the movements of machine 10. For ease of description, the exemplary embodiment of FIG. 1 will be referred to for the duration of this disclosure unless otherwise specified. It is understood, however, that the exemplary actuator systems and/or other components described herein, as well as their respective methods of operation, may be used with the machines 10 (i.e., the power shovel of FIG. 1 and the dredge of FIG. 1*a*) illustrated in either of FIGS. 1 and 1*a*.

Gantry member 16 may be a structural frame member, for example a general A-frame member, that is configured to anchor one or more cables 30 to body 14. Gantry member 16 may be extend from body 14 in a vertical direction away from base 12. Gantry member 16 may be located rearward of boom 18 relative to tool 22 and, in the disclosed exemplary embodiment, fixed in a single orientation and position. Cables 30 may extend from an apex of gantry member 16 to a distal end of boom 18, thereby transferring a weight of boom 18, tool 22, and a load contained by tool 22 into body 14.

Boom 18 may be pivotally connected at a base end to body 14, and constrained at a desired vertical angle relative to work surface 24 by cables 30. Additional cables 32 may extend from body 14 over a pulley mechanism 34 located at the distal end of boom 18 and around a pulley mechanism 36 of tool 22. Cables 32 may connect tool 22 to body 14 by way of one or more motors (not shown), such that a rotation of the motors functions to reel in or spool out cables 32. The reeling in and spooling out of cables 32 may affect the height and angle of tool 22 relative to work surface 24. For example, when cables 32 are reeled in, the decreasing effective length of cables 32 may cause tool 22 to rise and tilt backward away from work surface 24. In contrast, when cables 32 are spooled out, the increasing effective length of cables 32 may cause tool 22 to lower and tilt forward toward work surface 24.

Dipper handle 20 may be pivotally connected at one end to a general midpoint of boom 18, and at an opposing end to a corner of tool 22 adjacent pulley mechanism 36 (e.g., rearward of pulley mechanism 36). In this position, dipper handle 20 may function to maintain a desired distance of tool 22 away from boom 18 and ensure that tool 22 moves through a desired arc as cables 32 are reeled in and spooled out. In the disclosed embodiment, dipper handle 20 may be connected to boom 18 at a location closer to the base end of boom 18, although other configurations are also possible. As will be described in more detail below and as shown in FIG. 2, dipper handle 20 may be provided with a crowd cylinder 38 that functions to extend or retract dipper handle 20. In this manner, the distance between tool 22 and boom 18 (as well as the arcuate trajectory of tool 22) may be adjusted.

Tool 22, in the disclosed embodiment, is known as a dipper. A dipper is a type of shovel bucket having a pivotal door 40 located at a back side opposite a front side excavation opening 42. Door 40 may be hinged along one edge of the back side, so that it can be selectively opened and closed by the operator of machine 10 during an excavating operation. Door 40 may be moved between the opened and closed positions by gravity, and held closed or released by way of a dipper actuator 44. For example, when tool 22 is lifted upward toward the distal end of boom 18 by reeling in of cables 32, a releasing action of dipper actuator 44 may allow the weight of door 40 (and any material within tool 22) to swing door 40 downward away from tool 22. This motion may allow material collected within tool 22 to spill from tool 22 out the back side. In contrast, when tool 22 is lowered toward work surface 24, the weight of door 40 may cause door 40 to swing back toward tool 22. Dipper actuator 44 may then be deactivated to retain door 40 in its closed position.

In the disclosed embodiment, dipper actuator 44 may be remotely controlled, such as by way of an electric signal, a hydraulic signal, a pneumatic signal, a wireless signal, or another type of signal known in the art. It is contemplated, however, that a cable may alternatively be mechanically connected to and used to activate dipper actuator 44, if desired.

As shown in FIG. 2, dipper actuator 44 may be a powered type of actuator. For example, dipper actuator 44 may embody one or more hydraulic cylinders and/or motors that are selectively provided with high-pressure fluid to initiate the door releasing/retaining movements thereof. It is contemplated that dipper actuator 44 may be associated with a latch (not shown) and configured to move the latch between locked and unlocked positions. It is also contemplated that dipper actuator 44 may instead be associated with over-center linkage that locks and unlocks movement of door 40 with or without a latch. It is further contemplated that dipper actuator 44 may facilitate locking and unlocking of door 40 in any other manner known in the art.

The power for dipper actuator 44 may be provided by way of a hydraulic system 48. Hydraulic system 48 may include, among other things, a tank 50 configured to hold a supply of fluid, a pump 52 configured to increase a pressure of the fluid, one or more accumulators configured to hold the pressurized fluid, and a valve 56 configured to regulate flows of the fluid between the different components of hydraulic system 48.

Tank 50 may constitute a reservoir configured to hold a supply of fluid. The fluid may include, for example, a dedicated hydraulic oil, an engine lubrication oil, a transmission lubrication oil, or any other fluid known in the art. One or more hydraulic systems within machine 10 may draw fluid from tank 50 via a supply passage 58 and return fluid to tank 50 via a return passage 60. It is contemplated that hydraulic system 48 may be connected to multiple separate fluid tanks or to a single tank, as desired.

Pump 52 may draw fluid from tank 50 via supply passage 58 and pressurize the fluid to a predetermined level. Pump 52 may be, for example, a variable displacement pump, a fixed displacement pump (shown in FIG. 2), or another source known in the art. Pump 52 may be drivably connected to power source 28 (referring to FIG. 1) of machine 10 by way of a countershaft (not shown), a belt (not shown), an electrical circuit (not shown), or in any other suitable manner. Alternatively, pump 52 may be indirectly connected to power source 28 via a torque converter, a reduction gear box, or in another suitable manner. Pump 52 may produce one or more different and/or independent streams of pressurized fluid directed to the different components of hydraulic system 48.

The fluid pressurized by pump 52 may be directed to opposing ends of crowd cylinder 38 within dipper handle 20 to selectively cause crowd cylinder 38 to extend or retract. For example, the pressurized fluid may be directed to a first or head chamber 62 of crowd cylinder 38 via a head chamber passage 64, while fluid within a second or rod chamber 66 of crowd cylinder 38 may be drained back to tank 50 at the same time via a rod chamber passage 68. The filling of head chamber 62 and simultaneous draining of rod chamber 66 may result in extension of crowd cylinder 38, and such an extension may increase the distance between tool 22 and body 12 (i.e., the extension of "crowd" tool 22 further out into the working material) and increase the radius of the arcuate trajectory of tool 22. In contrast, the draining of head chamber 62 and the simultaneous filling of rod chamber 66 may result in retraction of crowd cylinder 38. This retraction may function to draw tool 22 closer to body 12 and decrease its trajectory radius.

Valve 56 may be fluidly coupled with crowd cylinder 38, tank 50, and pump 52 to regulate the filling and draining of crowd cylinder 38. Valve 56 may have any number of valve elements that are selectively movable between flow-passing and flow-blocking positions to achieve the extension and retraction of crowd cylinder 38 described above. These valve elements may be movable based on a signal, for example an electronic signal, a hydraulic pilot signal, or any other type of signal known in the art. The control signals that cause the valve elements to move may be generated based on input received from the operator of machine 10.

Crowd cylinder 38, in addition to providing dipper-positioning functionality, may also function as a conduit for power supplied to tool 22 (e.g., to dipper actuator 44). In particular, crowd cylinder 38 may include an internal passage 72 formed within a rod 74 of crowd cylinder 38. Passage 72 may extend from head chamber 62 to an external port 76 located at the opposing end of crowd cylinder 38. In this configuration, as high-pressure fluid is supplied to head chamber 62 (and/or as crowd cylinder 38 engages a resistant object and pressures within head chamber 62 increase), a portion of the fluid may flow from head chamber 62 into passage 72 and down nearly the entire length of rod 74 to exit crowd cylinder 38 via port 76. Thus, even as crowd cylinder 38 extends or retracts, the pressurized fluid may still be delivered to the same location at the distal end of dipper handle 20.

The pressurized fluid supplied to the distal end of dipper handle 20 via crowd cylinder 38 may be utilized as a remote power source at tool 22 for any number of different applications. In the disclosed exemplary embodiment of FIG. 2, the pressurized fluid is used to drive dipper actuator 44. It is contemplated, however, that the pressurized fluid may additionally or alternatively be used for other purposes, such as to power a grease pump (not shown) that lubricates components of tool 22, to power snubbers (not shown) that cushion movements of door 40, to power pitch braces (not shown) that adjust angular orientations of tool 22, and/or to power other dipper actuators known in the art.

The pressurized fluid may be supplied from crowd cylinder 38 to dipper actuator 44 via a supply passage 78 and a dipper control valve 80. Dipper control valve 80 may be movable between a first position at which the pressurized fluid is directed from supply passage 78 into a first pressure chamber (not shown) of dipper actuator 44 while fluid is simultaneously discharged from a second pressure chamber (not shown), to a second position at which fluid is discharged from the first chamber and a portion of the discharged fluid is redirected into the second chamber. When high-pressure fluid is directed into the first chamber and fluid is simultaneously discharged from the second chamber (i.e., when dipper control valve 80 is in the first position), dipper actuator 44 may be configured to release door 40, allowing door 40 to swing according to forces of gravity acting thereon. When dipper control valve 80 is in the second position, door 40 may be closed under the force of gravity and maintained in the closed position.

In some instances, the high-pressure fluid supplied via crowd cylinder 38 may not be immediately needed for operation of dipper actuator 44. In this situations, the high-pressure fluid may be stored for future use within a high-pressure accumulator 81. Specifically, the high-pressure fluid from crowd cylinder 38 may be directed through supply passage 78, past a check valve 82, and into high-pressure accumulator 81. Then, when the pressurized fluid is subsequently needed to power dipper actuator 44, the high-pressure fluid may exit high-pressure accumulator 81 and be directed via supply passage 78 through dipper control valve 80 into dipper actuator 44.

A pressure relief valve 83 may be associated high-pressure accumulator 81 to help inhibit over-pressurization of high-pressure accumulator 81 and/or to help reduce shock loading of dipper actuator 44. During either of these conditions, the fluid in hydraulic system 48 may be selectively directed through a passage 84 and pressure relief valve 83 into a low-pressure accumulator 86 or alternatively through a bypass passage 88 and past a check valve 90 back to crowd cylinder 38. Low-pressure accumulator 86 may be disposed in parallel with high-pressure accumulator 81, and the fluid discharged from dipper actuator 44 may also be directed, via a return passage 92, into low-pressure accumulator 86 and/or through bypass passage 88 back to crowd cylinder 38 when dipper control valve 80 is in either of the first or second positions.

In the disclosed embodiment, high-pressure accumulator 81 may have about the same volume as low-pressure accumulator 86, but a much higher pressure capacity. In particular, the volumes of high- and low-pressure accumulators 81, 86 may each be sized to fill dipper actuator 44 about three times without being refilled themselves. And, the operating pressure of high-pressure accumulator 81 may be about ten to fifteen times the operating pressure of low-pressure accumulator 86. Specifically, the operating pressure of high-pressure accumulator 81 may be about 3,000 psi, while the operating pressure of low-pressure accumulator may be about 200-300 psi.

INDUSTRIAL APPLICABILITY

The disclosed dipper actuator and hydraulic system may be used in any power shovel application where component longevity and reliability are desired. The disclosed dipper actuator may have improved longevity due to its remote power supply and wireless control. The disclosed dipper actuator may have improved reliability because of the reduction of associated components (e.g., cables, wires, conduits, etc.) that stretch and shrink during dipper handle extensions and retractions. Operation of hydraulic system 48 and dipper actuator 44 will now be explained.

During operation of machine 10, the operator may raise and lower tool 22 by causing cables 32 to be reeled in or spooled out. As the operator reels in or spools out cables 32, tool 22 may move through an arcuate trajectory at least partially defined by an effective length of dipper handle 20. Specifically, as crowd cylinder 38 extends or retracts, the length of dipper handle 20 may proportionally increase or decrease. As the length of dipper handle 20 increases, the radius of the arcuate dipper trajectory may increase by a corresponding amount. Likewise, as the length of dipper handle 20 decreases, the radius of the arcuate dipper trajectory may decrease. The changing length of dipper handle 20 may also function to move tool 22 into and out of a material bank (i.e., move fore/aft), for a given effective length of cables 32.

The length of crowd cylinder 38 may change by selectively supplying pressurized fluid to either head chamber 62 or rod chamber 66, while simultaneously draining fluid from the other chamber. During extending and retracting motions of crowd cylinder 38, as long as a pressure of the fluid within head chamber 62 exceeds a pressure within high-pressure accumulator 81, fluid from head chamber 62 may flow through passage 72 along the length of rod 74 and through port 76 into passage 78. This pressurized fluid may then flow past check valve 82 and into high-pressure accumulator 81 in preparation for use by dipper actuator 44.

When the operator of machine 10 desires door 40 of tool 22 to open, the operator may indicate this desire by way of an input device (not shown) within the cabin of machine 10. A corresponding signal may be generated and wirelessly transmitted to dipper control valve 80, causing dipper control valve 80 to move against a spring bias to its first position (upper position shown in FIG. 2). In this position, high-pressure fluid from within high-pressure accumulator 81 may flow into one chamber of dipper actuator 44, while fluid within an opposing chamber of dipper actuator 44 may be directed through dipper control valve 80 to low-pressure accumulator 86. This imbalance of pressure may cause dipper actuator to move (e.g., to extend in the case of dipper actuator 44 being a liner cylinder, or to rotate in the case of dipper actuator 44 being a rotary actuator) and release door 40. In some applications, dipper actuator 44 may move a latch to release door 40. In other applications, dipper actuator 44 may move associated linkage over a center position to release door 40. It is contemplated that dipper actuator 44 may move in any other manner know in the art to release door 40.

Once dipper actuator 44 has moved to release door 40, door 40 may be free to move. It is important to note that movement of dipper actuator 44 may not necessarily result in movement of door 40. Door 40 may only move when tool 22 is oriented to allow gravity to pull door 40 open after dipper actuator 44 has moved to release door 40. If either condition is not satisfied (i.e., if dipper actuator 44 has not been moved or door 40 is not oriented properly), door 40 may not open.

Door 40 may close any time its orientation is such that gravity pulls door 40 closed. After door 40 is closed, dipper actuator 44 may be moved to lock door 40 in the closed position. Specifically, dipper control valve 80 may be released after door 40 is opened, and allowed to return to its second position (lower position shown in FIG. 2) in preparation for the next door opening event. When dipper control valve 80 is in the second position, the closing movement of door 40 may cause dipper actuator 44 to move in a direction that pushes fluid from the first chamber into the second chamber and fluid from the first chamber back through dipper control valve 80 and into low-pressure accumulator 86. In some applications, the latch described above may be spring-biased into a locked position after door 40 is closed to maintain door 40 in the closed position. In other applications, the closing of door 40 may move the over-center link described above to a locked position.

The fluid within low-pressure accumulator 86 may selectively be directed back through check valve 90 and passage 88 to crowd cylinder 38. That is, when the pressure of fluid within passage 88 is greater than the pressure of fluid within passage 72 (e.g., during retraction of crowd cylinder 38), the fluid may flow back through crowd cylinder 38 to tank 50 mounted in body 14 (referring to FIG. 1).

It will be apparent to those skilled in the art that various modifications and variations can be made to the disclosed power shovel and dipper actuator. Other embodiments will be apparent to those skilled in the art from consideration of the specification and practice of the disclosed power shovel and dipper actuator. It is intended that the specification and example be considered as exemplary only, with a true scope being indicated by the following claims and their equivalents.

What is claimed is:

1. A hydraulic system for a power shovel, comprising:

a tank;

a pump configured to draw fluid from the tank and pressurize the fluid;

a crowd cylinder extendable and retractable to adjust a length of a dipper handle;

a valve in fluid communication with the tank, the pump, and the crowd cylinder, the valve movable to fill chambers of the crowd cylinder with fluid pressurized by the pump and to drain the chambers of the crowd cylinder to cause extension and retraction of the crowd cylinder;

a dipper actuator located at an end of the crowd cylinder; and a passage extending through the crowd cylinder to communicate with the dipper actuator.

2. The hydraulic system of claim 1, wherein the passage is formed within a rod of the crowd cylinder and extends along a length of the rod.

3. The hydraulic system of claim 2, further including a dipper control valve disposed between the rod and the dipper actuator, the dipper control valve movable to control a flow of pressurized fluid from the rod into the dipper actuator.

4. The hydraulic system of claim 3, further including a first accumulator disposed between the rod and the dipper control valve.

5. The hydraulic system of claim 4, further including a check valve disposed between the rod and the first accumulator, the check valve configured to provide a unidirectional flow of fluid from the rod into the first accumulator.

6. The hydraulic system of claim 4, further including a second accumulator disposed in parallel with the first accumulator.

7. The hydraulic system of claim 6, further including a second check valve disposed between the rod and the second accumulator, the second check valve configured to provide a unidirectional flow of fluid from the second accumulator into the rod.

8. The hydraulic system of claim 6, further including:

a relief passage extending between the first accumulator and the second accumulator; and a pressure relief valve disposed within the relief passage, the pressure relief valve being configured to selectively allow fluid from the first accumulator to pass into the second accumulator based on a pressure of fluid in the first accumulator.

9. The hydraulic system of claim 8, wherein:

the first accumulator is a high-pressure accumulator; and the second accumulator is a low-pressure accumulator.

10. The hydraulic system of claim 9, wherein the first accumulator has an operating pressure about 10-15 times greater than an operating pressure of the second accumulator.

11. The hydraulic system of claim 8, wherein the first and second accumulators have volumes that are about equal.

12. The hydraulic system of claim 11, wherein a volume of the first accumulator is sufficient to fill the dipper actuator about three times.

13. The hydraulic system of claim 6, wherein the valve is movable from a first position at which fluid from the first accumulator is directed into a first chamber of the dipper actuator, to a second position at which fluid from the first chamber is directed into a second chamber of the dipper actuator and into the second accumulator.

14. The hydraulic system of claim 1, wherein the dipper actuator is movable to selectively release a door of a dipper.

15. A method of operating a power shovel, comprising:

pressurizing fluid;

directing pressurized fluid to chambers of a crowd cylinder and draining fluid from the chambers of the crowd cylinder to cause the crowd cylinder to adjust a length of a dipper handle; and directing pressurized fluid through the crowd cylinder to a dipper actuator located at an end of the crowd cylinder.

16. The method of claim 15, further including selectively regulating a flow of fluid from the crowd cylinder into the dipper actuator and from the dipper actuator back to the crowd cylinder to move the dipper actuator and release a dipper door.

17. The method of claim 16, further including storing high-pressure fluid received from the crowd cylinder for subsequent use in the dipper actuator.

18. The method of claim 17, further including:

storing low-pressure fluid received from the dipper actuator; and directing stored low-pressure fluid back through the crowd cylinder.

19. The method of claim 18, further including selectively directing stored high-pressure fluid to join stored low-pressure fluid to relieve a pressure of the stored high-pressure fluid.

20. A power shovel, comprising:

a body;

a boom pivotally connected at a base end to the body;

a dipper handle pivotally connected at a base end to a midpoint of the boom;

a crowd cylinder disposed within the dipper handle and being configured to extend and retract to change a length of the dipper handle;

a dipper pivotally connected to a distal end of the dipper handle;

a dipper actuator associated with the dipper and configured to selectively release a door of the dipper;

a passage extending through the crowd cylinder to the dipper actuator;

at least one accumulator located between the passage and the dipper actuator; and a dipper control valve fluidly connected between the at least one accumulator and the dipper actuator.

* * * * *